United States Patent [19]

Pulejo

[11] 4,128,243

[45] Dec. 5, 1978

[54] MAGIC SQUARE PUZZLE

[76] Inventor: Salvatore Pulejo, 445 Marilu St., Richardson, Tex. 75080

[21] Appl. No.: 801,258

[22] Filed: May 27, 1977

[51] Int. Cl.[2] ..... A63F 9/08
[52] U.S. Cl. ..... 273/156
[58] Field of Search ..... 273/156, 157 R

[56] References Cited

U.S. PATENT DOCUMENTS

| | | | |
|---|---|---|---|
| 455,066 | 6/1891 | Stern | 273/156 |
| 487,063 | 11/1892 | Bailey | 273/156 |
| 2,202,078 | 5/1940 | Bartelt | 273/156 X |

FOREIGN PATENT DOCUMENTS

| | | | |
|---|---|---|---|
| 2406775 | 8/1975 | Fed. Rep. of Germany | 273/136 H |

*Primary Examiner*—Anton O. Oechsle

[57] ABSTRACT

A magic square puzzle including a main piece which is square in plan view and four auxiliary rectangular pieces each having a square cross section. The top surface of the main piece is divided into four equal square shaped quadrante each provided with a numerical indicium. Three longitudinal surfaces of each rectangular piece is divided into three square shaped segments each having a numerical indicium therein. The object of the puzzle is to arrange the rectangular pieces around the periphery of the main piece in a effort to achieve a magic square solution.

1 Claim, 6 Drawing Figures

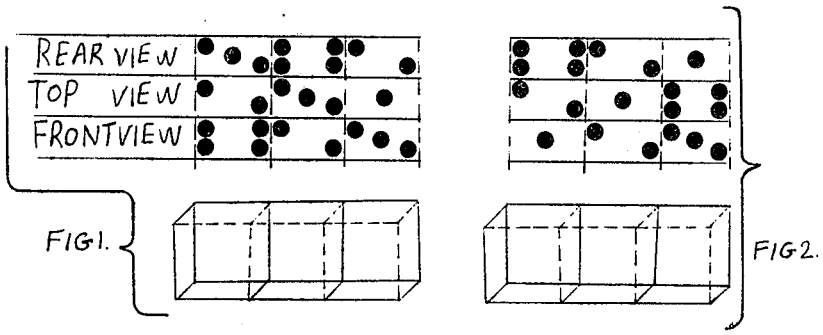
REAR VIEW
TOP VIEW
FRONTVIEW
FIG 1.
FIG 2.
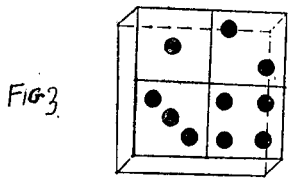
FIG 3.
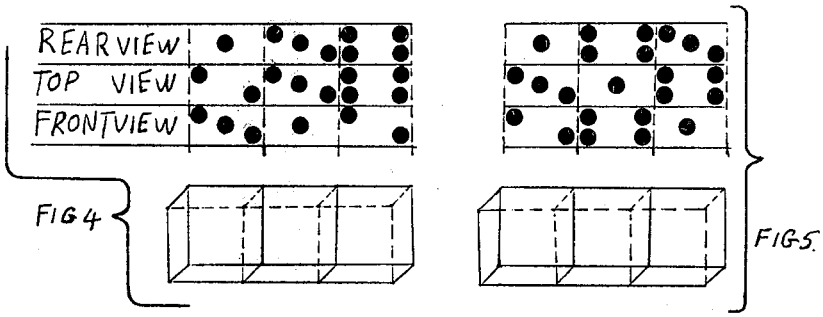
REAR VIEW
TOP VIEW
FRONTVIEW
FIG 4
FIG 5.
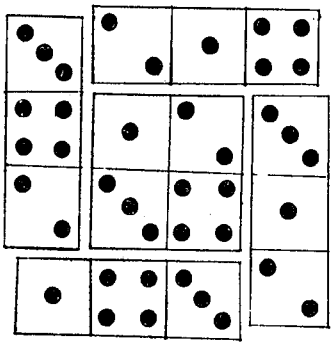
FIG 6.

MAGIC SQUARE PUZZLE

BACKGROUND OF THE INVENTION

This invention relates to puzzles and more specifically to magic square puzzles wherein components are assembled in an effort to achieve a solution.

SUMMARY OF THE INVENTION

Accordingly, it is an object of the present invention to provide a new and improved magic square puzzle.

A further object of the present invention is to provide a magic square puzzle comprised of assemblable components.

BRIEF DESCRIPTION OF THE DRAWINGS

In the drawing:

FIGS. 1, 2, 4 and 5 are respectively perspective views of each of the four rectangular pieces along with unfolded view of the numerical indicia provided on three of the longitudinally extending surfaces of the respective pieces;

FIG. 3 is a perspective view of the square piece; and

FIG. 6 is a view of the respective pieces assembled to form a correct magic square solution.

DESCRIPTION OF THE PREFERRED EMBODIMENT

The puzzle of the present invention includes four rectangularly shaped pieces or blocks and a main square shaped piece or block.

As shown in FIG. 3, the uppermost surface of the main piece is divided into four square shaped quadrants of equal size with each quadrant being provided with one or more pips to represent corresponding numerical values.

As shown in FIGS. 1,2,4 and 5, each of the rectangularly shaped pieces has a pair of lines circumscribed in planes perpendicular to its longitudinal axis to divide each planar surface thereof into three square shaped sections. The sections on three surfaces of each rectangular piece are each selectively provided with one or more pips to represent corresponding numerical values.

The object of the puzzle is to assemble the rectangularly shaped puzzle pieces around the square main piece in such order and with such surfaces uppermost that a correct magic square solution (i.e., the sums of the pips taken horizontally, vertically and diagonally across the quadrants and segments being equal) is achieved.

I claim:

1. A magic square puzzle comprising a square shaped piece and four rectangular pieces each having a square cross section and a length one and one half times the length of a side of the square shaped piece; the top surface of said square shaped pieces being divided into four equal square shaped quadrants by a pair of perpendicular lines, a numerical indicium being disposed in each said quadrant; and each longitudinal surface of each rectangular piece being divided into three square shaped segments by a pair of lines circumscribing said pieces in planes perpendicular to the longitudinal axis of each rectangular piece, each segment on three surfaces of each rectangular piece having a numerical indicium therein and being of the same size as each quadrant; whereby the rectangular piece can be rotated about their longitudinal axes and placed in surrounding relation to said square shaped piece in an effort to make equal the sums of said numerical indicia taken horizontally, vertically and diagonally across said quadrants and segments.

* * * * *